US010707002B2

(12) United States Patent
Vincon et al.

(10) Patent No.: US 10,707,002 B2
(45) Date of Patent: Jul. 7, 2020

(54) ELECTROMAGNETIC ADJUSTING DEVICE AND USE OF SUCH AN ADJUSTING DEVICE

(71) Applicant: ETO Magnetic GmbH, Stockach (DE)

(72) Inventors: Peter Vincon, Stockach (DE); Thomas Golz, Kenzingen (DE); Sebastian Bölling, Salem (DE); Philipp Fangauer, Constance (DE); Reinhold Hammer, Baden (DE)

(73) Assignee: ETO MAGNETIC GMBH, Stockach (DE)

( * ) Notice: Subject to any disclaimer, the term of this patent is extended or adjusted under 35 U.S.C. 154(b) by 100 days.

(21) Appl. No.: 16/072,534

(22) PCT Filed: Jan. 20, 2017

(86) PCT No.: PCT/EP2017/051190
§ 371 (c)(1),
(2) Date: Jul. 25, 2018

(87) PCT Pub. No.: WO2017/129488
PCT Pub. Date: Aug. 3, 2017

(65) Prior Publication Data

US 2019/0043648 A1 Feb. 7, 2019

(30) Foreign Application Priority Data

Jan. 25, 2016 (DE) ..... 10 2016 101 263

(51) Int. Cl.
*H01F 7/126* (2006.01)
*H01F 7/128* (2006.01)
(Continued)

(52) U.S. Cl.
CPC ..... *H01F 7/126* (2013.01); *F01L 1/047* (2013.01); *H01F 7/081* (2013.01); *H01F 7/128* (2013.01);
(Continued)

(58) Field of Classification Search
CPC . H01F 7/16; H01F 7/081; H01F 7/126; H01F 7/128; H01F 7/129; H01F 7/1607;
(Continued)

(56) References Cited

U.S. PATENT DOCUMENTS 5,652,560 A * 7/1997 Carter ..... H01F 7/081 335/255
6,085,704 A * 7/2000 Hara ..... F01L 9/04 123/90.11
(Continued)

FOREIGN PATENT DOCUMENTS

CN 101689419 A 3/2010
CN 104662265 A 5/2015
(Continued)

OTHER PUBLICATIONS

International search report for patent application No. PCT/EP2017/051190 dated Apr. 3, 2017.
(Continued)

*Primary Examiner* — Mohamad A Musleh
(74) *Attorney, Agent, or Firm* — Bachman and Lapointe PC; George Coury

(57) ABSTRACT

An electromagnetic actuator device with a plurality of actuator units (10, 12) having in each case an armature tappet which is movable relative to a stationary coil along an axial tappet direction when said coil is energised, said actuator units being received in respectively assigned actuator housings (11, 13) such that in an installed and/or assembled state of the electromagnetic actuator device one respective end portion (16) of the armature tappets may come into engagement in a controlled manner with an actuator partner which is able to be assigned thereto, wherein the plurality of actuator units is mechanically connected to a bracket-like and/or bridge-like connecting unit (14) made of polymer material such that the actuator
(Continued)

housings are movable relative to one another by the action and in accordance with a predetermined bending property and/or elasticity of the connecting unit, in particular in a plane perpendicular to a tappet direction of the armature tappets which are further preferably guided in an axially parallel manner to one another.

14 Claims, 1 Drawing Sheet

(51) Int. Cl.

| | |
|---|---|
| ***H01F 7/16*** | (2006.01) |
| ***F01L 1/047*** | (2006.01) |
| ***H01F 7/08*** | (2006.01) |
| ***H01F 7/129*** | (2006.01) |
| *F01L 13/00* | (2006.01) |

(52) U.S. Cl.
CPC ..... *H01F 7/129* (2013.01); *H01F 7/16* (2013.01); *H01F 7/1607* (2013.01); *F01L 2013/0052* (2013.01); *F01L 2820/031* (2013.01); *H01F 2007/086* (2013.01)

(58) Field of Classification Search
CPC ..... H01F 2007/086; F01L 1/047; F01L 2013/0052; F01L 2820/031
See application file for complete search history.

(56) References Cited

U.S. PATENT DOCUMENTS

| | | | |
|---|---|---|---|
| 6,967,550 | B2 | 11/2005 | Elendt et al. |
| 8,176,887 | B2 | 5/2012 | Golz et al. |
| 2004/0201441 | A1 | 10/2004 | Elendt et al. |

FOREIGN PATENT DOCUMENTS

| | | | |
|---|---|---|---|
| DE | 20114466 | U1 | 1/2002 |
| DE | 202008008142 | U1 | 10/2008 |
| DE | 102012018095 | A1 | 3/2014 |

OTHER PUBLICATIONS

Chines office action for patent application No. 201180008124.6 dated Sep. 18, 2019.
German patent application No. 10 2016 101 263.7 dated Sep. 26, 2016.

* cited by examiner

ELECTROMAGNETIC ADJUSTING DEVICE AND USE OF SUCH AN ADJUSTING DEVICE

BACKGROUND OF THE INVENTION

The present invention relates to an electromagnetic actuator device according to the preamble of the main claim.

The present invention further relates to a use of such an electromagnetic actuator device.

Electromagnetic actuator devices, in which an armature unit which is configured in the manner of a tappet and which is able to be driven as a reaction to the energising of stationary coil means is guided in an axial direction so as to be able to be moved out of an actuator housing, are generally known from the prior art and are used for very different actuating tasks, in particular also in a motor vehicle context.

In this case, for example, a use of such actuators for actuating the camshaft of an internal combustion engine has proved to be an advantageous use; generic actuators in which, for example, permanent magnets on the armature side cooperate in a repelling manner with the (energised) coil means are characterised by brief switching times (thus high switching dynamics) and robustness and reliability in operation, are also suitable for inexpensive mass production.

However, the disclosed application of actuating a camshaft generally requires more than one actuator unit; the armature tappet engaging in a controlled manner in a shifting groove (groove track) of a camshaft for actuating purposes generally requires at least one second tappet to be provided, generally adjacent thereto, in order to be able to effect, in addition to a first movement, a second opposing movement of the camshaft.

This technology is generally known per se and is used in the mass production of motor vehicles. With regard to an arrangement of a plurality of armature tappets, in this case it is known, on the one hand, to provide these tappets (as the respective armature tappets) in a common housing adjacent to one another and to operate them in a suitable manner.

However, this leads to large housing dimensions when minimum (engagement) spacings of the tappet ends have to be ensured. Such large housings are in turn problematical when installed in the restricted space conditions on the engine block. Moreover, such an arrangement is problematical with regard to assembly tolerances and/or operating tolerances which are unavoidable on a motor vehicle internal combustion engine, since when the tappets are repeatedly guided in a common housing this generally does not allow for any tolerance compensation as might be necessary, for example, in the case of thermally-induced fitting problems during installation, for example.

However, the use of two or more separate actuator units not only entails an additional cost for the assembly and anchoring of each individual associated actuator housing, but each of these actuator units also has to be electrically connected and wired separately, so that the structural and the assembly cost is also increased here.

SUMMARY OF THE INVENTION

It is, therefore, the object of the present invention to improve a generic electromagnetic actuator device with a plurality of actuator units comprising in each case an armature tappet which is movable relative to stationary coil means, both with regard to compact space-saving installation dimensions and also with regard to an insensitivity relative to installation and fitting tolerances at the point of installation, primarily relating to the respective actuator partners cooperating with the engagement ends of the armature tappets, and at the same time to provide a device which is able to be manufactured in a manner which is both suitable for mass production and cost-effective.

The object is achieved by the electromagnetic actuator device having the features of the main claim; advantageous developments of the invention are described in the subclaims. Additionally, protection within the scope of the invention is claimed for a use of such an electromagnetic actuator device for the discussed preferred (but not exclusive) purpose of use within the context of actuating the camshaft of a motor vehicle internal combustion engine.

Advantageously, according to the invention the plurality of actuator units (wherein a preferred exemplary embodiment comprises two actuator units) is mechanically connected to a bracket-like and/or bridge-like connecting unit made of polymer material, such that the respective actuator housings of the actuator units are movable relative to one another by the action of the connecting unit and corresponding to a predetermined bending property and/or elasticity of the connecting unit. In this manner, tolerance compensation is possible in a structurally simple manner, with a high level of safety in terms of installation and operation, and at the same time in a flexible manner, so that according to the invention the connecting unit made of the polymer material (which further preferably and advantageously, for example, may be a glass fibre-reinforced plastics, namely polyamide—glass fibre-reinforced plastics) achieves the effect of a tolerance compensation means within the scope of the invention.

More specifically, in terms of production technology, in this case it is advantageous to connect this bracket-like and/or bridge-like connecting unit, which further preferably may also be provided with a predetermined inflection angle, to the respectively associated polymer actuator housings during an automated production method, wherein this may be advantageously carried out both by welding, bonding or other joining techniques and additionally or alternatively also by encapsulating by injection-moulding (for example by inserting such a bracket body into an injection-moulding tool when producing the actuator housings which are in turn produced advantageously and as a development from injection-mouldable polymer material); additionally or alternatively, an integral connection may also be produced with one or more of the actuator housings during the course of production.

A particularly suitable and preferred embodiment of the invention provides that the actuator device merely comprises one connecting and plug unit for activating and/or energising the plurality of the coil means associated with the respective actuator units. In this manner, the connection and cabling cost is advantageously reduced and, for example as a development and advantageously, the bracket-like and/or bridge-like connecting portion may be used within the scope of the invention in order to guide supply cables thereon or therein (for example advantageously protected by embedding), so that subsequently during the assembly of the electromagnetic actuator device according to the invention only a single plug contact is required for the common connection and/or plug unit. This may itself advantageously and according to the invention also be located on the connecting unit (connecting portion) and, for example, be produced therewith in an injection-moulding method as a manufacturing technique.

Whilst in principle the geometric implementation of the connecting unit for the connection according to the invention of the at least two actuator units may be of any kind, it has also been advantageously proven to position this connecting unit in each case on a lateral and/or outer portion of the actuator housings, by using the above-described advantageous (and easily automatable) production methods. Depending on the material used and the geometric and elasticity conditions, it has preferably been proven in this case to select an axial extent of such a bracket-like and/or arcuate portion relative to a similar axial extent of the housing which is connected thereto, of no more than 40%, and preferably this extent may be even smaller, up to less than 20%. A particularly preferred development of the invention with regard to practical handling properties during the assembly of the device according to the invention at the point of installation provides that in each case grip, handling and/or flange portions are assigned to a pair of adjacent actuator units in each case on the end side (front face). These grip, handling and/or flange portions preferably partially protrude radially so that the handling and/or actuation by assembly and/or operating personnel is also possible using one hand. At the same time, these portions which are further preferably configured to be planar on the end side form a defined upper edge (and/or surface) of the device, and a longitudinal edge of the opposing actuator housings which further advantageously extends transversely to the axial direction permits a gap-like spacing which both visually provides a practical spacing during installation (subject to tolerances) and limits the adjustment travel of the individual actuators to one another.

As a result, therefore, the present invention is eminently suitable for installation conditions which are subject to tolerances on a motor vehicle internal combustion engine, but the present invention is not limited to this use according to the invention. Instead, in principle the invention may be used in all actuator structures in which a compact arrangement, which is able to be automatically produced and which is also able to be inserted in a flexible manner with regard to installation tolerances, is designed to be constructed from a plurality of actuator units.

BRIEF DESCRIPTION OF THE DRAWINGS

Further advantageous and features and details of the invention are disclosed from the following description of preferred exemplary embodiments and with reference to the drawings, in which.

DETAILED DESCRIPTION

Figure 1:
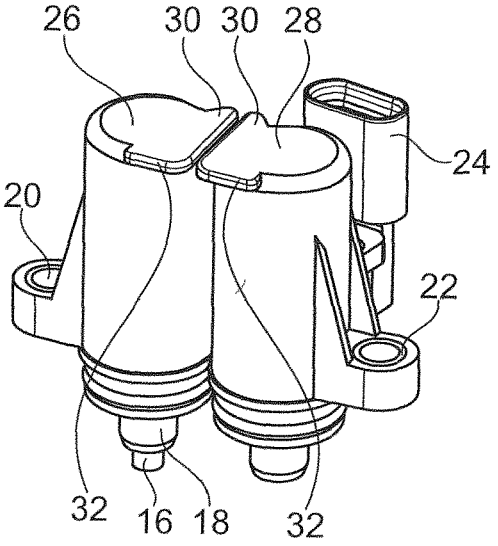
FIG. 1 shows a perspective view of the electromagnetic actuator device according to a first exemplary embodiment of the invention with two actuator units.

FIGS. 1 to 5 show different views of the electromagnetic actuator device of the first and preferred exemplary embodiment. A pair of actuator units 10, 12 in this case is connected by a bridge 14 as tolerance compensating means (in this case produced from glass fibre-reinforced polyamide, as is selected for the material of the actuator housings 11, 13 of the individual actuators 10, 12) so that in accordance with the installation and engagement dimensions, which are subject to tolerances, for the end portions 16 (of armature tappets, not shown, guided in the respective housings 11, 13) a fit and/or accurate access is possible relative to the opposing actuator partner. In the described installation context this actuator partner is assigned in each case actuating grooves in order to permit an adjustment of an internal combustion engine camshaft.

Figure 2:
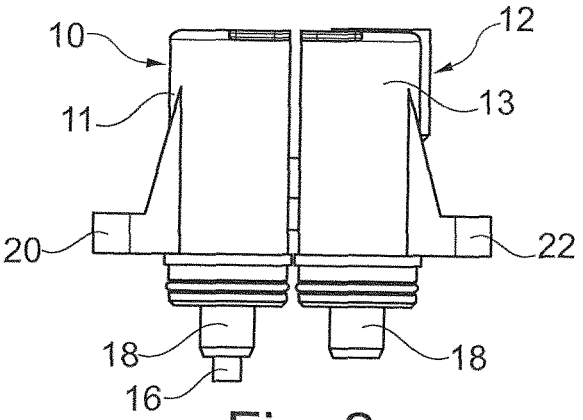
FIG. 2 shows a side view of the device according to FIG. 1.
Figure 3:
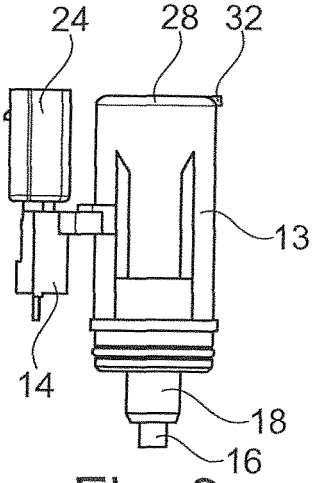
FIG. 3 shows a side view rotated axially by 90° relative to the view of FIG. 2.

The individual actuators 10, 12 are, for example, constructed as electromagnetic actuator devices of the type described in DE 201 14 466 U1, wherein this embodiment with permanent magnets on the armature side, which then cooperate with stationary coil means in the housings 11 and/or 13, is merely by way of example and other embodiments of electromagnetic actuator devices may also be provided, which in the manner shown drive an engagement end 16 of an armature tappet in the manner shown in FIGS. 1 to 3, for example, on the end side in a controlled manner out of stationary guides 18 of the respective actuators 10, 12.

Additionally visible in the respective views are lateral assembly flanges 20, 22 for a corresponding assembly on both sides, wherein, in principle, the provision of the bridge 14 according to the invention (connecting unit and/or connecting portion) permits the fastening of the entire arrangement shown on merely one of these flanges.

Figure 4:
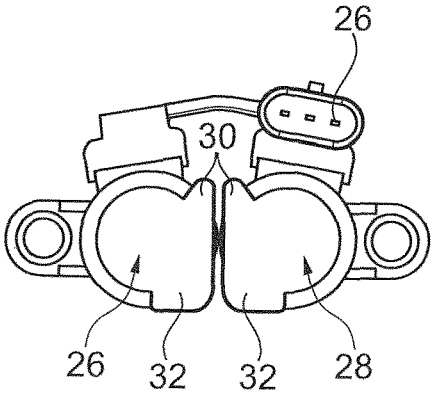
FIG. 4 shows a plan view of the device of the exemplary embodiment of FIG. 1 to FIG. 3 from the direction of the common connection and plug unit and a common end surface.
Figure 5:
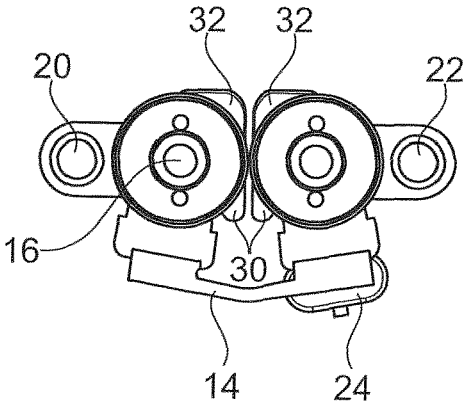
FIG. 5 shows a view from below relative to the view of FIG. 4 tilted by 180° of the device from the outlet side of the respective armature tappets.

As, in particular, the views of FIGS. 1, 3 and 4 illustrate, a plug portion and/or bush portion 24 which is integrally injection-moulded with the bracket 14 is located adjacent to the actuator housing 13. Connection contacts 26 shown by way of example (FIG. 4) indicate how, via this connection, the stationary coils which are respectively contained in the housings 11, 13 are also energised separately from one another and thus may be activated for driving the respective armature tappets.

The views of FIGS. 1 and 4 illustrate further how, axially opposing an outlet end of the armature tappet engagement regions 16, the arrangement on the front face of one respective housing 11, 13 has planar end portions 26, 28 which when aligned permit an end surface or, in the side view of FIG. 2 and FIG. 3, a defined end edge of the device.

In the plan view (FIG. 4) it is also clear how these end portions provide grip-like and/or flange-like projections 30, 32 relative to the primarily cylindrical housings 11, 13 so that, for example from the direction of FIG. 4, assembly personnel may grip the arrangement with a secure grip using one hand and, for example, insert the arrangement at the point of assembly using one hand. The straight edge which respectively extends between the portions 30, 32—so that in the view of FIG. 4 a gap is formed between the pair of actuator units—also indicates visually a spacing in the installed state (in this case subject to tolerances).

The side view, in particular of FIG. 3, illustrates a size ratio of the bridge (connecting unit 14) relative to an extent of the polymer part of the housing (in this case 13): in accordance with the desired stiffness and elasticity properties of the bridge 14 (describing according to FIG. 5 an inflection angle of approximately 20°), this bridge extends in a direction parallel to the axial direction (i.e. in FIG. 3 vertically in the direction of the plane of the figure) only over approximately 30% of the total length, so that the constructional space is also optimised here.

The invention claimed is:

1. An electromagnetic actuator device with a plurality of actuator units (10, 12) each comprising an armature tappet which is movable relative to stationary coil means along an axial tappet direction when said coil means are energised, said actuator units being received in respectively assigned actuator housings (11, 13) such that in an installed and/or assembled state of the electromagnetic actuator device one respective end portion (16) of the armature tappets is engageable in a controlled manner with an actuator partner assigned thereto, wherein the plurality of actuator units is mechanically connected to a bracket-like and/or bridge-like connecting unit (14) made of polymer material, such that the actuator housings are movable relative to one another in accordance with a predetermined bending property and/or elasticity of the connecting unit, wherein the actuator housings are movable relative to one another in a plane perpendicular to a tappet direction of the armature tappets.

2. The device according to claim 1, wherein the connecting unit is connected to the actuator housings by welding, bonding, encapsulating by injection-moulding or as a subassembly produced integrally with at least one of the actuator housings.

3. The device according to claim 1 further comprising a connection and/or plug unit (24) which is provided for energising the coil means of the plurality of actuator units together.

4. The device according to claim 3, wherein the connection and/or plug unit (24) is integrally positioned on the connecting unit (14).

5. The device according to claim 3, wherein the connection and/or plug unit (24) is produced from a polymer material.

6. The device according to claim 1, wherein the connecting unit is configured such that electrical lines for energising the coil means run at least partially in or through the connecting unit (14).

7. The device according to claim 1, wherein the connecting unit acts unreleasably on a lateral portion and/or on an outer portion of the actuator housings and/or has an extent parallel to an axial actuator direction which has less than 50% of a minimum extent of one of the actuator housings parallel to the axial actuator direction.

8. The device according to claim 7, wherein the connecting unit has an extent parallel to the axial actuator direction which has less than 30% of a minimum extent of one of the actuator housings parallel to the axial actuator direction.

9. The device according to claim 7, wherein the connecting unit has an extent parallel to the axial actuator direction which has less than 20% of a minimum extent of one of the actuator housings parallel to the axial actuator direction.

10. The device according to claim 1, wherein grip, handling and/or flange portions (30, 32) are assigned to a pair of adjacent actuator units on a front region of the respective actuator housing opposing a tappet outlet end, such that said portions define a minimum spacing of the actuator units as a spacing gap extending at least partially parallel, and permit a manual handling of the actuator device by access using one hand.

11. The device according to claim 10, wherein the grip, handling and/or flange portions (30, 32) are designed as a flange portion which is integrally formed on one respective actuator housing, which is flat and which projects radially from the actuator housing.

12. The device according to claim 10 wherein the grip, handling and/or flange portions (30, 32) with one respective planar side on an end side determine a common end surface of the electromagnetic actuator device.

13. A use of the electromagnetic actuator device according to claim 1, for assembly on an internal combustion engine of a motor vehicle for camshaft adjustment thereof.

14. The device according to claim 1, wherein the actuator housings are guided in an axially parallel manner to one another.

* * * * *